US006174662B1

(12) United States Patent
Merkel et al.

(10) Patent No.: US 6,174,662 B1
(45) **Date of Patent: *Jan. 16, 2001**

(54) COMBINATIONS OF PURINE-RELEASING PYRAZOLONE DIR COUPLERS AND PYRAZOLONE OF PYRAZOLOTRIAZOLE IMAGING COUPLERS

(75) Inventors: Paul B. Merkel, Victor; Jerrold N. Poslusny, Rochester; David A. Steele, Webster, all of NY (US)

(73) Assignee: Eastman Kodak Company, Rochester, NY (US)

( * ) Notice: Under 35 U.S.C. 154(b), the term of this patent shall be extended for 0 days.

This patent is subject to a terminal disclaimer.

(21) Appl. No.: 09/400,206

(22) Filed: Sep. 21, 1999

Related U.S. Application Data

(62) Division of application No. 08/994,663, filed on Dec. 19, 1997, now Pat. No. 5,989,798.

(51) Int. Cl.[7] ..... G03C 1/08; G03C 7/26; G03C 7/32

(52) U.S. Cl. ..... 430/544; 430/549; 430/555; 430/558; 430/957

(58) Field of Search ..... 430/544, 549, 430/555, 558, 957

(56) References Cited

U.S. PATENT DOCUMENTS 5,958,662 * 11/1999 Merkel et al. ..... 430/544
5,989,798 * 11/1999 Merkel et al. ..... 430/544

FOREIGN PATENT DOCUMENTS 0 867 763 A1 * 9/1998 (EP) .
4-278942 * 10/1992 (JP) .

* cited by examiner

*Primary Examiner*—Geraldine Letscher
(74) *Attorney, Agent, or Firm*—Edith A. Rice

(57) ABSTRACT

A photographic element comprises: (a) a support; and (b) at least one silver halide emulsion layer; wherein said emulsion layer contains (c) at least one magenta dye-forming pyrazolone DIR coupler of structure I; and (d) at least one magenta dye-forming imaging coupler of structure II, structure IIIa or structure IIIb, below:

I

II

IIIa

IIIb wherein the substituents are as defined in the specification.

18 Claims, No Drawings

COMBINATIONS OF PURINE-RELEASING PYRAZOLONE DIR COUPLERS AND PYRAZOLONE OF PYRAZOLOTRIAZOLE IMAGING COUPLERS

CROSS-REFERENCE TO RELATED APPLICATIONS

This is a divisional of application Ser. No., 08/994,663, filed Dec. 19, 1997, now U.S. Pat. No. 5,989,798.

BACKGROUND OF THE INVENTION

Many photographic materials, particularly color negative films, contain so-called DIR (development inhibitor releasing) couplers. In addition to forming imaging dye, DIR couplers release inhibitors that can restrain silver development in the layer in which release occurs as well as in other layers of a multilayer photographic material. DIR couplers can help control gamma (contrast), can enhance sharpness (acutance), can reduce granularity and can provide color correction via interlayer interimage effects. U.S. Pat. No. 3,933,500 broadly discloses couplers with azole coupling-off groups. Specifically coupler 13 of U.S. Pat. No. 3,933,500 discloses a pyrazolone parent coupler with a simple purine coupling-off group. Purine-releasing pyrazolone DIR couplers are also disclosed in commonly assigned, copending U.S. patent applications Ser. Nos. 08/824,226 and 08/824,223 both filed Mar. 25, 1997.

PROBLEM TO BE SOLVED BY THE INVENTION

There has been a need for more effective magenta dye-forming DIR couplers. Magenta DIR couplers that provide high interimage color correction are particularly desirable for modem color negative films. To efficiently react with oxidized developer and provide inhibition effects, a magenta dye-forming DIR coupler must have a reactivity that is properly matched with that of the magenta imaging coupler that is coated with it and must release an inhibitor that efficiently retards silver development. Since a DIR coupler is normally coated at lower levels than the imaging coupler, the reactivity of the DIR must usually be high to compete for reaction with oxidized developer.

SUMMARY OF THE INVENTION

This invention provides a combination of a pyrazolone DIR coupler and pyrazolone or pyrazolotriazole image coupler. A photographic element containing these couplers possess all of the above-mentioned desirable properties, particularly the ability to provide higher interimage color correction than combinations of the prior art, such as those disclosed in the above-mentioned U.S. Pat. No. 3,933,500 and copending U.S. patent applications Ser. Nos. 08/824,226 and 08/824,223. The DIR couplers used in accordance with this invention are 1-aryl-3-anilino-5-pyrazolones that release a purine derivative from the coupling position (4-position).

One aspect of this invention comprises a photographic element comprising (a) a support; and (b) at least one silver halide emulsion layer; wherein said emulsion layer contains (c) at least one magenta dye-forming pyrazolone DIR coupler of structure I; and (d) at least one magenta dye-forming imaging coupler of structure II, structure IIIa or structure IIIb, below:

I

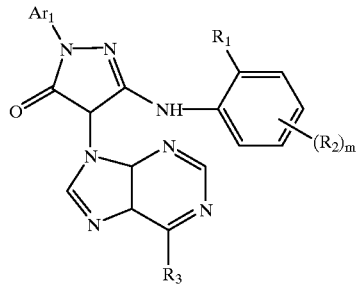

wherein:

$Ar_1$ is an unsubstituted aryl group or an aryl group with one or more substituents selected from the group consisting of halogen atoms, and alkyl, phenyl, alkoxy, phenoxy, carbonamido, sulfonamido, carbamoyl, sulfamoyl, alkoxycarbonyl, aryloxycarbonyl, acyloxy, alkylsulfonyl, arylsulfonyl, sulfonyloxy and alkylthio groups;

$R_1$ is a hydrogen or halogen atom or an alkyl or alkoxy group;

each $R_2$ is individually selected from the group consisting of halogen atoms, and alkyl, phenyl, alkoxy, phenoxy, carbonamido, sulfonamido, carbamoyl, sulfamoyl, alkoxycarbonyl, aryloxycarbonyl, acyloxy, alkylsulfonyl, arylsulfonyl, sulfoxyl, sulfonyloxy, alkylthio, arylthio, cyano and imido groups and is in the para position or either meta position relative to the NH group;

m is 0, 1, 2 or 3;

$R_3$ is an alkylthio, arylthio, alkoxy, phenoxy, sulfonamido or carbonamido (—$NHCOR_4$) group; and $R_4$ is an alkyl, phenyl, alkoxy or phenoxy group;

II

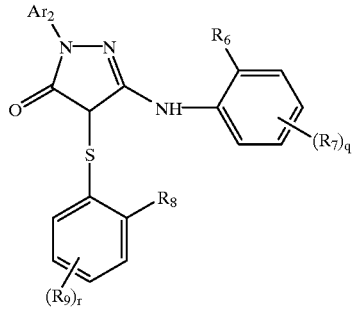

wherein:

$Ar_2$ is an unsubstituted aryl group or an aryl group with one or more substituents individually selected from the group consisting of halogen atoms, and alkyl, phenyl, alkoxy, phenoxy, carbonamido, carbamoyl, acyloxy, alkoxycarbonyl, aryloxycarbonyl, sulfonamido, sulfamoyl, alkylsulfonyl, arylsulfonyl, sulfoxyl, sulfonyloxy, alkylthio and cyano groups;

$R_6$ is a hydrogen or halogen atom or an alkyl or alkoxy group;

each $R_7$ may be in the para position or either meta position relative to the NH group and is individually selected from the group consisting of halogen atoms and alkyl, phenyl, alkoxy, phenoxy, carbonamido, carbamoyl, acyloxy, alkoxycarbonyl, aryloxycarbonyl, sulfonamido, sulfamoyl, alkylsulfonyl, arylsulfonyl, sulfoxyl, sulfonyloxy, cyano, imido, alkylthio and arylthio groups;

q is, 0, 1, 2 or 3;

$R_8$ and $R_9$ are individually selected from the group consisting of hydrogen and halogen atoms and alkyl, phenyl, alkoxy, phenoxy, carbonamido, carbamoyl, acyloxy, alkoxycarbonyl, aryloxycarbonyl, sulfonamido, sulfamoyl, alkylsulfonyl, arylsulfonyl, sulfoxyl, sulfonyloxy and cyano groups;

r is 0, 1 or 2;

$R_9$ is in the para or either meta position relative to the sulfur atom; and the total number of carbon atoms in $R_8$ and $R_9$ taken together is at least 4;

IIIa

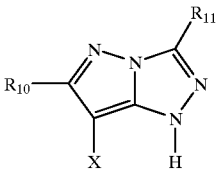

IIIb

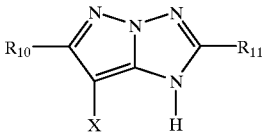

wherein:

$R_{10}$ and $R_{11}$ are individually selected from the group consisting of hydrogen and halogen atoms and alkyl, phenyl, alkoxy, phenoxy, carbonamido and sulfonamido groups;

X is hydrogen or a coupling-off group; and the total number of carbon atoms in $R_{10}$ and $R_{11}$ taken together is at least 8.

ADVANTAGEOUS EFFECT OF THE INVENTION

The combination of the DIR coupler of formula I and an image coupler of formula (II), (IIIa) or (IIIb) provides a photgaphic element that has the desired contrast, accutance, granularity and interimage effects.

DETAILED DESCRIPTION OF THE INVENTION

As mentioned above, the photographic element of this invention comprises (a) a support; and (b) at least one silver halide emulsion layer; wherein said emulsion layer contains (c) at least one magenta dye-forming pyrazolone DIR coupler of structure I; and (d) at least one magenta dye-forming imaging coupler of structure II, structure IIIa or structure IIIb, below:

I

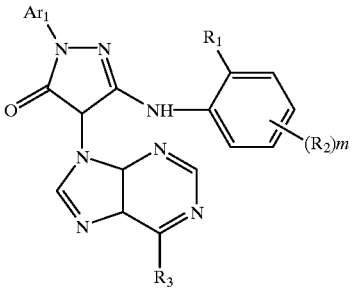

wherein:

$Ar_1$ is an unsubstituted aryl group or an aryl group with one or more substituents selected from the group consisting of halogen atoms, and alkyl, phenyl, alkoxy, phenoxy, carbonamido, sulfonamido, carbamoyl, sulfamoyl, alkoxycarbonyl, aryloxycarbonyl, acyloxy, alkylsulfonyl, arylsulfonyl, sulfonyloxy and alkylthio groups;

$R_1$ is a hydrogen or halogen atom or an alkyl or alkoxy group;

each $R_2$ is individually selected from the group consisting of halogen atoms, and alkyl, phenyl, alkoxy, phenoxy, carbonamido, sulfonamido, carbamoyl, sulfamoyl, alkoxycarbonyl, aryloxycarbonyl, acyloxy, alkylsulfonyl, arylsulfonyl, sulfoxyl, sulfonyloxy, alkylthio, arylthio, cyano and imido groups and is in the para position or either meta position relative to the NH group;

m is 0, 1, 2 or 3;

$R_3$ is an alkylthio, arylthio, alkoxy, phenoxy, sulfonamido or carbonamido (—$NHCOR_4$) group; and $R_4$ is an alkyl, phenyl, alkoxy or phenoxy group;

II

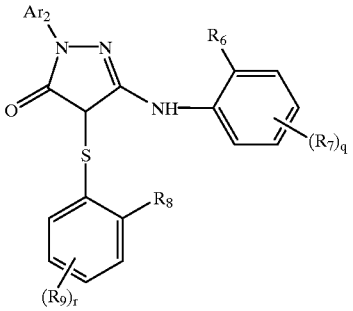

wherein:

$Ar_2$ is an unsubstituted aryl group or an aryl group with one or more substituents individually selected from the group consisting of halogen atoms, and alkyl, phenyl, alkoxy, phenoxy, carbonamido, carbamoyl, acyloxy, alkoxycarbonyl, aryloxycarbonyl, sulfonamido, sulfamoyl, alkylsulfonyl, arylsulfonyl, sulfoxyl, sulfonyloxy, alkylthio and cyano groups;

$R_6$ is a hydrogen or halogen atom or an alkyl or alkoxy group;

each $R_7$ may be in the para position or either meta position relative to the NH group and is individually selected from the group consisting of halogen atoms and alkyl, phenyl, alkoxy, phenoxy, carbonamido, carbamoyl, acyloxy, alkoxycarbonyl, aryloxycarbonyl, sulfonamido, sulfamoyl, alkylsulfonyl, arylsulfonyl, sulfoxyl, sulfonyloxy, cyano, imido, alkylthio and arylthio groups;

q is 0, 1, 2 or 3;

$R_8$ and $R_9$ are individually selected from the group consisting of hydrogen and halogen atoms and alkyl, phenyl, alkoxy, phenoxy, carbonamido, carbamoyl, acyloxy, alkoxycarbonyl, aryloxycarbonyl, sulfonamido, sulfamoyl, alkylsulfonyl, arylsulfonyl, sulfoxyl, sulfonyloxy and cyano groups;

r is 0, 1 or 2;

$R_9$ is in the para or either meta position relative to the sulfur atom; and the total number of carbon atoms in $R_8$ and $R_9$ taken together is at least 4;

IIIa

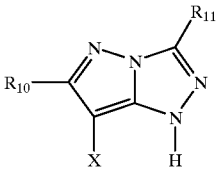

IIIb

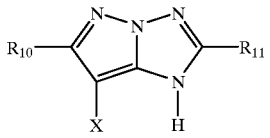

wherein:

$R_{10}$ and $R_{11}$ are individually selected from the group consisting of hydrogen and halogen atoms and alkyl, phenyl, alkoxy, phenoxy, carbonamido and sulfonamido groups;

X is hydrogen or a coupling-off group; and the total number of carbon atoms in $R_{10}$ and $R_{11}$ taken together is at least 8.

Preferably $Ar_1$ is a phenyl group with at least one ortho position unsubstituted, i.e. with a hydrogen atom in at least one of the positions ortho to the point of attachment to the pyrazolone nitrogen. Particularly useful are $Ar_1$ phenyl groups either with both ortho positions unsubstituted or with one unsubstituted ortho position and a chlorine, fluorine or methyl substituent in the other ortho position. Preferably $R_1$ is a chlorine or fluorine atom or a methyl group. In another preferred embodiment m is 1 and $R_2$ is an electron-withdrawing group either para to the NH group or para to the $R_1$ group. Particularly useful electron-withdrawing groups for $R_2$ are alkoxycarbonyl groups and alkylsulfonyl groups. In another preferred embodiment the sum of the Hammett sigma values for all of the $R_2$ groups is at least 0.3 (with reference to the NH position) to improve coupler stability on film storage. The use of Hammett sigma values to describe chemical properties is discussed, for example, in "Exploring QSAR, Fundamentals and Applications in Chemistry and Biology" C. Hansch and A. Leo, American Chemical Society, Washington, D.C. 1995.

In one useful embodiment of this invention $R_3$ is an alkylthio group with at least two carbon atoms. Preferably $R_3$ is a hydrolyzable —$SCH_2CO_2R_5$ group, wherein $R_5$ is an alkyl group with at least 3 carbon atoms, and preferably 4–8 carbon atoms, or a phenyl group. $R_4$ alkoxy groups or carbonamido groups with at least 4 carbon atoms, and preferably 5–9 carbon atoms, are also useful.

Combinations of pyrazolone DIR couplers of structure I with pyrazolotriazole imaging couplers of structure IIIa or IIIb of this invention are particularly useful and surprisingly effective in delivering inhibition and interlayer interimage. Since pyrazolotriazole couplers of structure IIIa or IIIb are often quite reactive, any DIR coupler that is coated with them must also be reactive and release an efficient inhibitor to provide the desired inhibition and interimage effects. The purine-releasing pyrazolone DIR couplers of structure I of this invention meet these requirements quite well. In one useful embodiment X of structure IIIa or IIIb is chlorine. Specifically contemplated is the use of the DIR plus imaging coupler combinations of this invention in the green sensitive layers or records of photographic elements, particularly in multlialyer color negative films.

The alkyl groups comprising $R_1$, $R_2$ and $R_4$–$R_{11}$ and substituted on $Ar_1$ or $Ar_2$ may be straight chain, branched or cyclic and may be unsubstituted or substituted. The alkoxy groups comprising $R_1$–$R_4$ and $R_6$–$R_{11}$ and substituted on $Ar_1$ or $Ar_2$ may be unbranched or branched and may be unsubstituted or substituted. The phenyl groups comprising $R_2$, $R_4$, $R_5$, and $R_7$–$R_{11}$ and substituted on $Ar_1$ or $Ar_2$ may be unsubstituted or substituted. The phenoxy groups comprising $R_2$–$R_4$ and $R_7$–$R_{11}$ and substituted on $Ar_1$ or $Ar_2$ may be unsubstituted or substituted. The carbonamido groups comprising $R_2$, $R_3$ and $R_7$–$R_{11}$ and substituted on $Ar_1$ or $Ar_2$ and the sulfonamido groups comprising $R_2$, $R_3$ and $R_7$–$R_{11}$ and substituted on $Ar_1$ or $Ar_2$ may be further substituted. The carbamoyl, sulfamoyl, alkoxycarbonyl, aryloxycarbonyl, acyloxy, alkylsulfonyl, arylsulfonyl, sulfoxyl, sulfonyloxy, alkylthio, arylthio, and imido groups comprising $R_2$, $R_3$ and $R_7$–$R_9$ and substituted on $Ar_1$ or $Ar_2$ may also be further substituted. Any substituent may be chosen to further substitute the $R_1$–$R_{11}$ groups of this invention that does not adversely affect the performance of the DIR or imaging couplers of this invention. Suitable substituents include halogen atoms, such as fluorine or chlorine, alkenyl groups, alkynyl groups, aryl groups, hydroxy groups, alkoxy groups, aryloxy groups, acyl groups, acyloxy groups, alkoxycarbonyl groups, aryloxycarbonyl groups, carbonamido groups (including alkyl-, aryl-, alkoxy-, aryloxy- and alkylaminocarbonamido groups), carbamoyl groups, carbamoyloxy groups, sulfonamido groups, sulfamoyl groups, alkylthio groups, arylthio groups, sulfoxyl groups, sulfonyl groups, sulfonyloxy groups, alkoxysulfonyl groups, aryloxysulfonyl groups, cyano groups and heterocyclic groups, such as 2-furyl, 3-furyl, 2-thienyl, 1-pyrrolyl, 2-pyrrolyl, N-succinimidyl and 1-imidazolyl groups. The phenyl groups comprising $R_2$, $R_4$, $R_5$ and $R_7$–$R_{11}$ , and on $Ar_1$ or $Ar_2$ and the phenoxy groups comprising $R_2$–$R_4$ and $R_7$–$R_{11}$ and on $Ar_1$ or $Ar_2$ may also be substituted with one or more unbranched, branched or cyclic alkyl groups.

Useful coated levels of the purine-releasing pyrazolone DIR couplers (I) of this invention range from about 0.005 to about 0.50 g/sq m, or more typically from 0.01 to 0.25 g/sq m. Useful coated levels of the pyrazolone (II) or pyrazolotriazole (IIIa or IIIb) imaging couplers of this invention range from about 0.02 to 1.50 g/sq m, or more typically from 0.04 to 0.75 g/sq m.

The couplers of this invention are usually utilized by dissolving them in high-boiling coupler solvents and then dispersing the organic coupler plus coupler solvent mixtures as small particles in aqueous solutions of gelatin and surfactant (via milling or homogenization). Removable auxiliary organic solvents such as ethyl acetate or cyclohexanone may also be used in the preparation of such dispersions to facilitate the dissolution of the coupler in the organic phase. Coupler solvents useful for the practice of this invention include aryl phosphates (e.g. tritolyl phosphate), alkyl phosphates (e.g. trioctyl phosphate), mixed aryl alkyl phosphates (e.g. diphenyl 2-ethylhexyl phosphate), aryl, alkyl or mixed aryl alkyl phosphonates, phosphine oxides (e.g. trioctylphosphine oxide), esters of aromatic acids (e.g. dibutyl phthalate, octyl benzoate, or benzyl salicylate) esters of aliphatic acids (e.g. acetyl tributyl citrate or dibutyl sebecate), alcohols (e.g. oleyl alcohol), phenols (e.g. p-dodecylphenol), carbonamides (e.g. N,N-dibutyldodecanamide or N-butylacetanalide), sulfoxides (e.g. bis(2-ethylhexyl)sulfoxide), sulfonamides (e.g. N,N-dibutyl-p-toluenesulfonamide) or hydrocarbons (e.g. dodecylbenzene). Additional coupler solvents and auxiliary solvents are noted in Research Disclosure, December 1989, Item 308119, p 993. Useful coupler:coupler solvent weight ratios range from about 1:0.1 to 1:8.0, with 1:0.2 to 1:4.0 being preferred. The couplers of this invention may also be coated from evaporated or washed dispersions prepared with removable auxiliary solvent but without permanent coupler solvent. The couplers of this invention may also be coated as ball-milled solid particle dispersions.

Examples of purine-releasing pyrazolone DIR couplers of structure I of this invention include, but are not limited to A1–A14, below:
A1
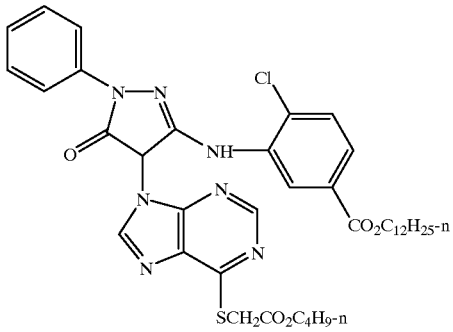
A2
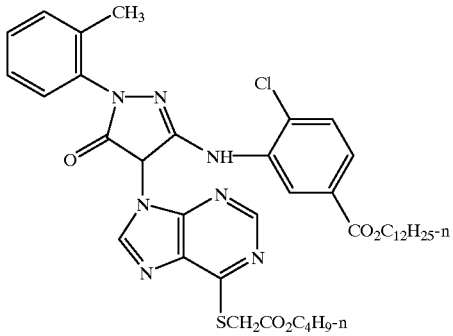
A3
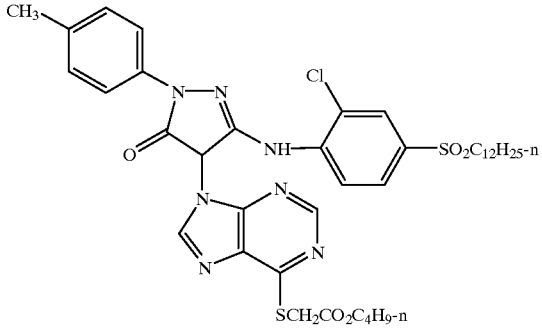
A4
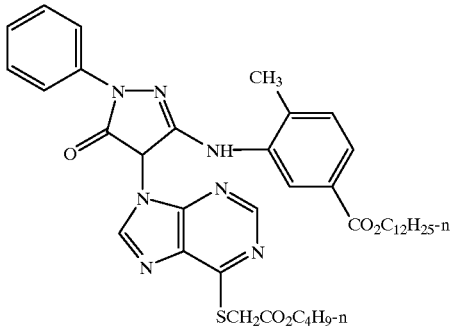
-continued
A5
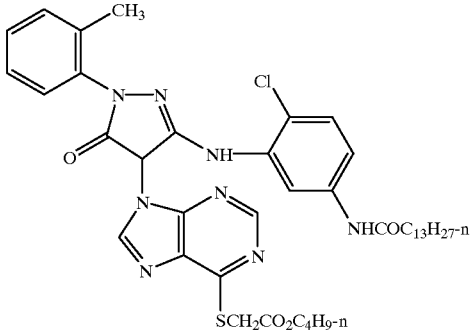
A6
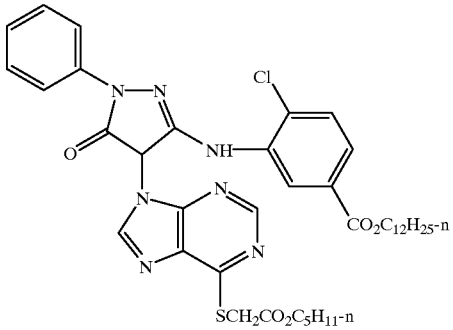
A7
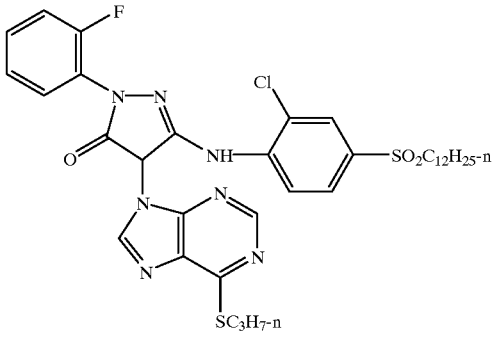
A8
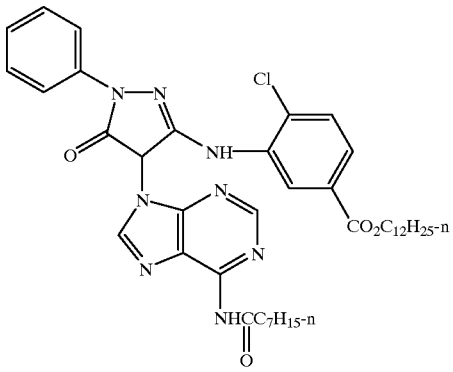

-continued
A9
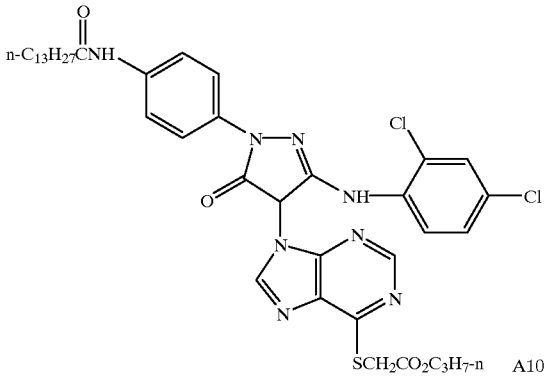
A10
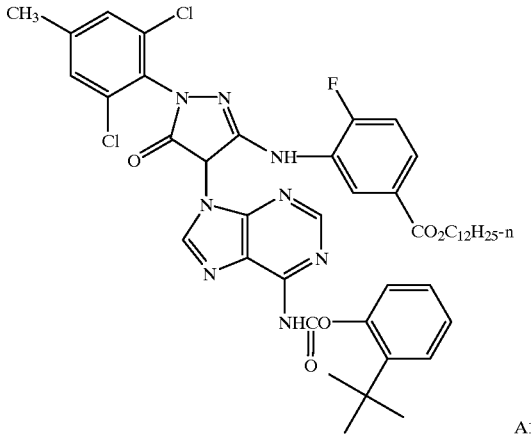
A11
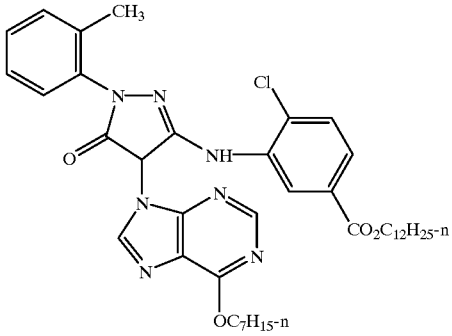
A12
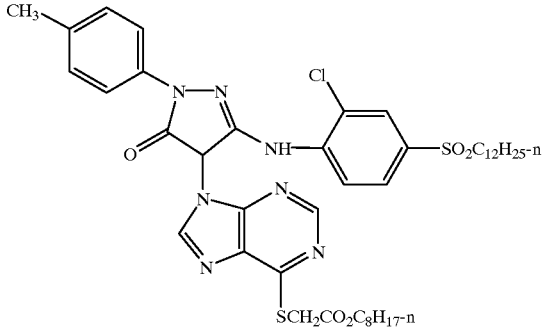
-continued
A13
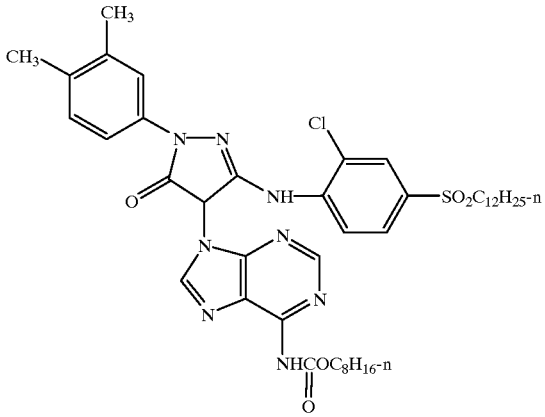
A14
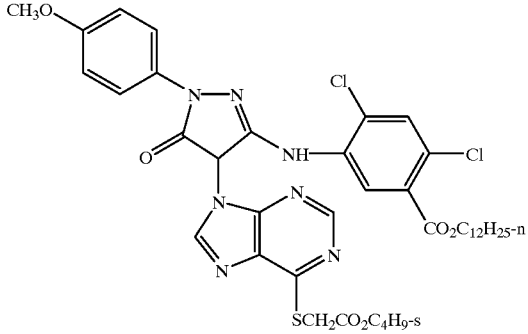
Examples of pyrazolone imaging couplers of structure II of this invention include, but are not limited to B1–B21, below:
B1
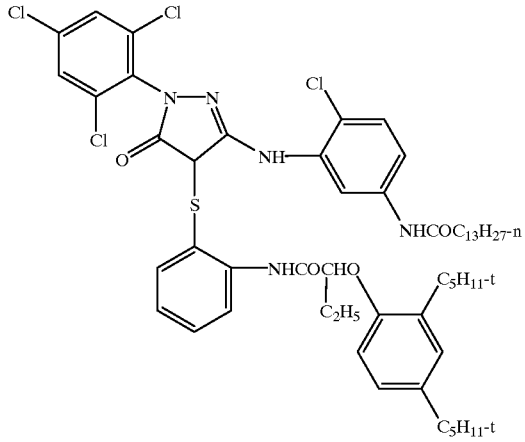

-continued
B2
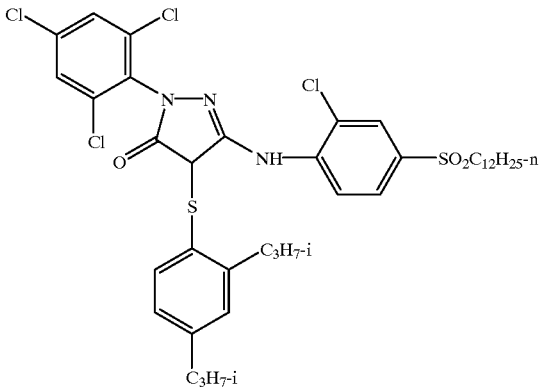
B3
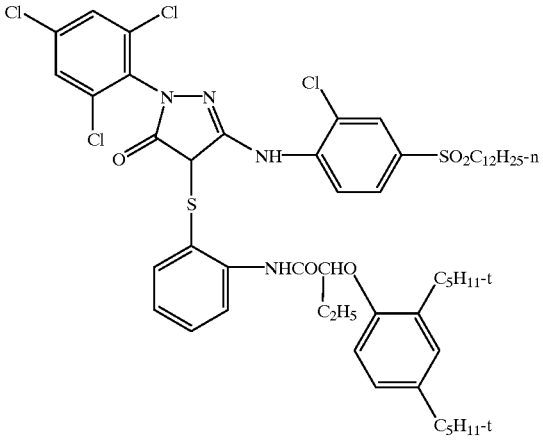
B4
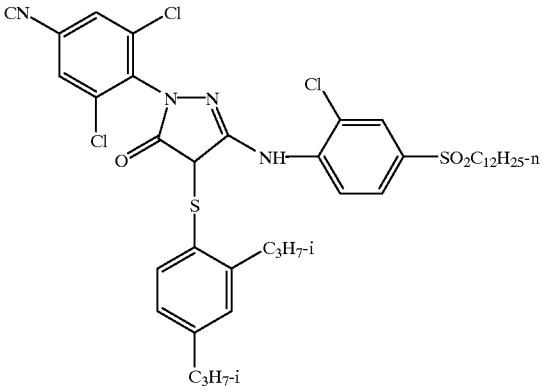
-continued
B5
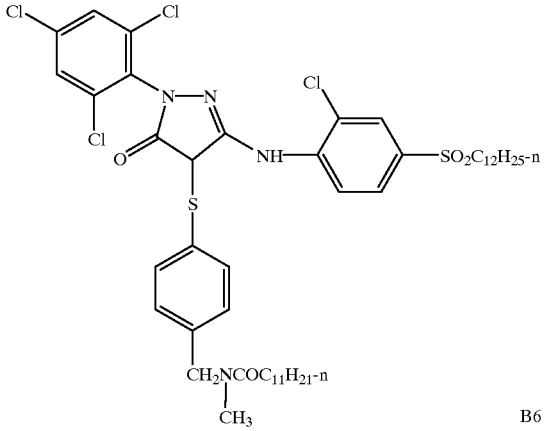
B6
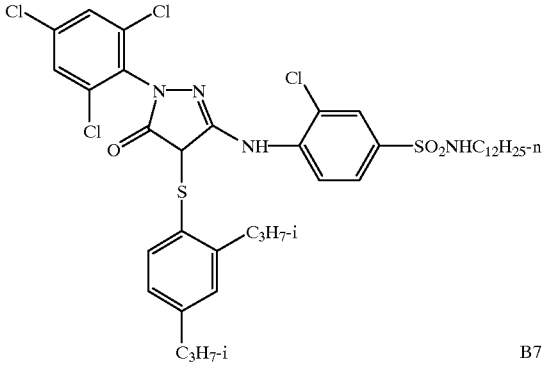
B7
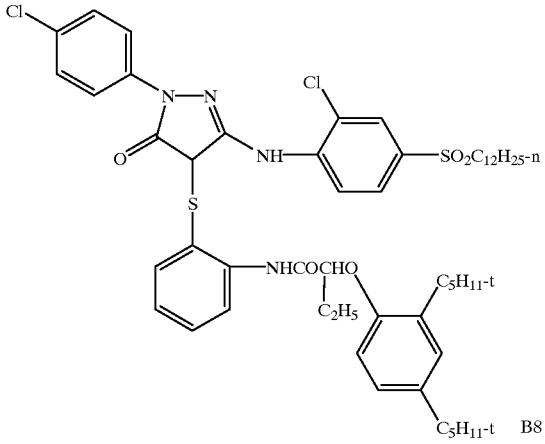
B8
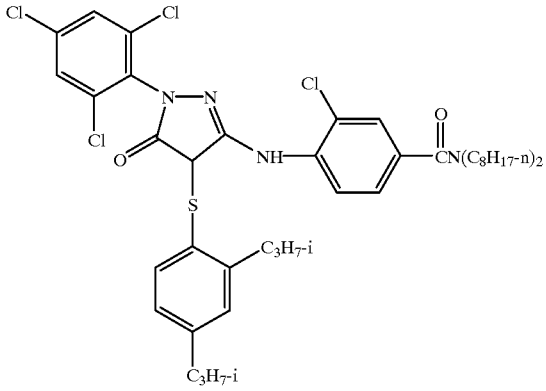

-continued
B9
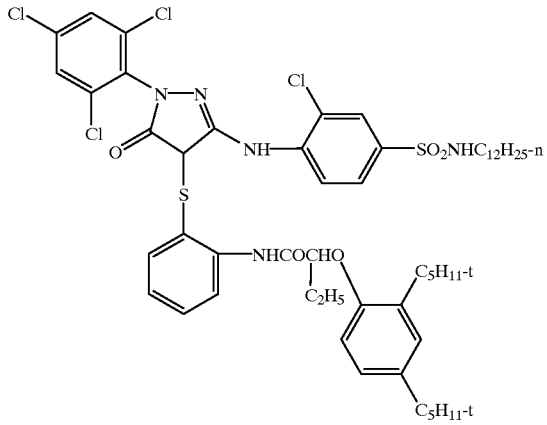
B10
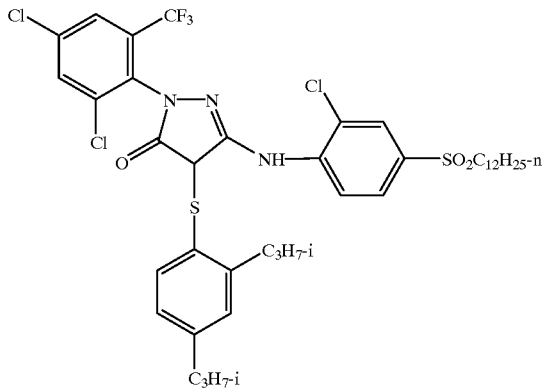
B11
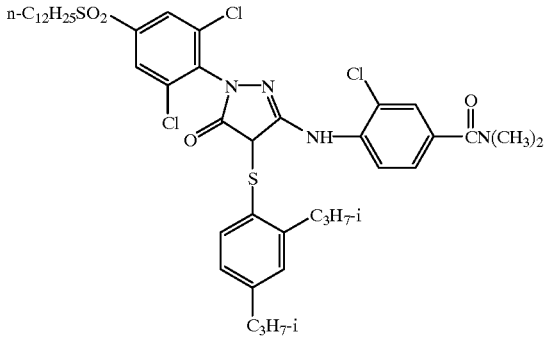
B12
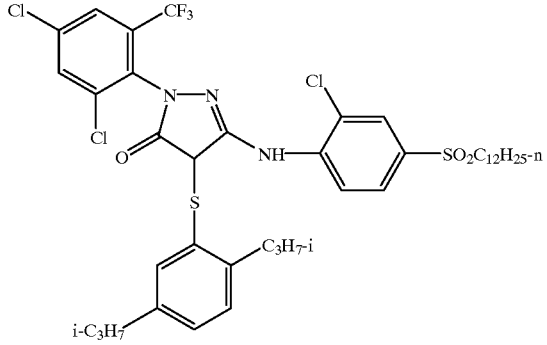
-continued
B13
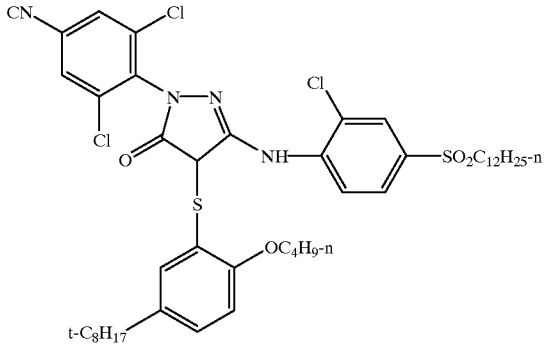
B14
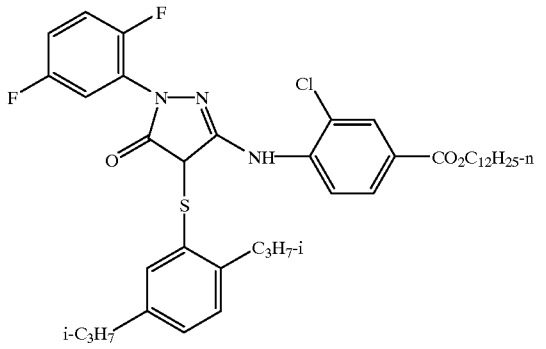
B15
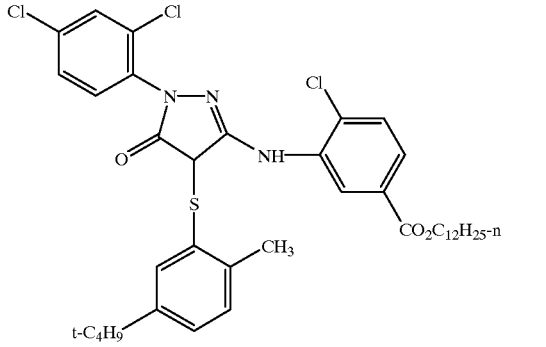
B16
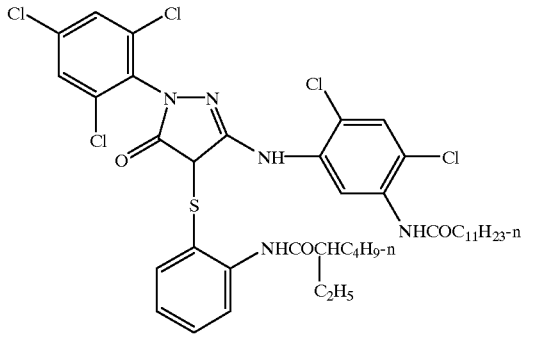

-continued
B17
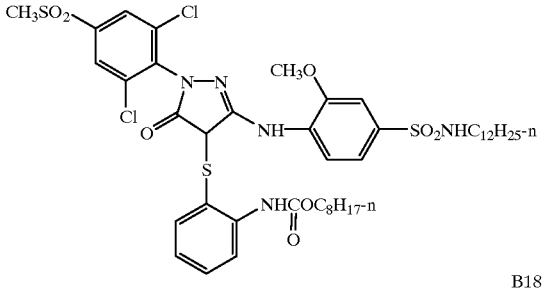
B18
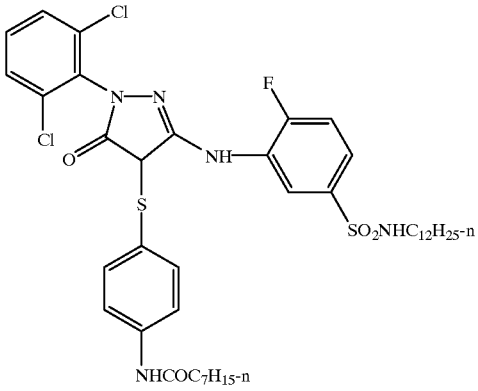
B19
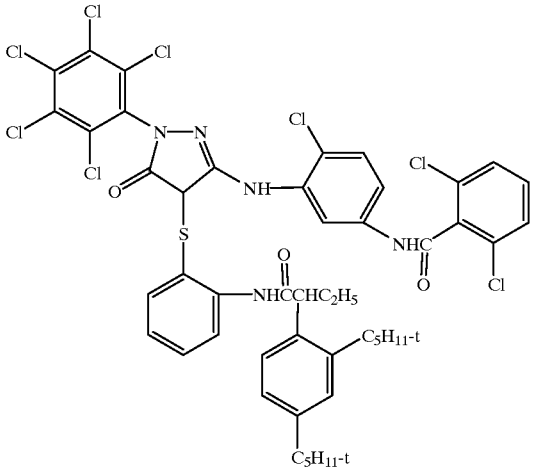
-continued
B20
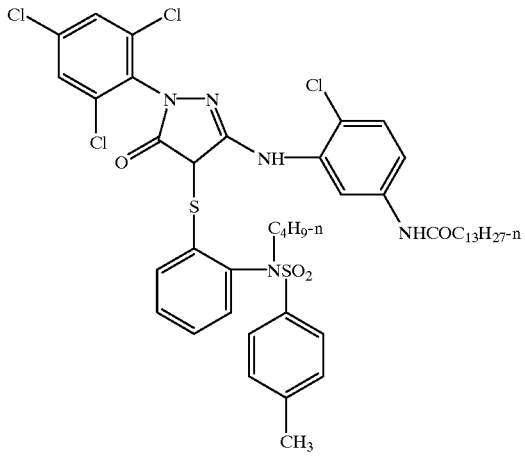
B21
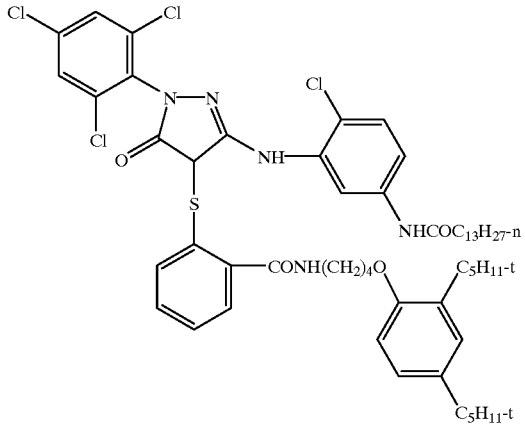
Examples of pyrazolotriazole imaging couplers of structure IIIa or IIIb of this invention include, but are not limited to, C1–C12, below:
C1
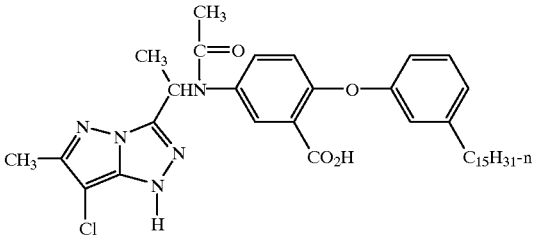
C2
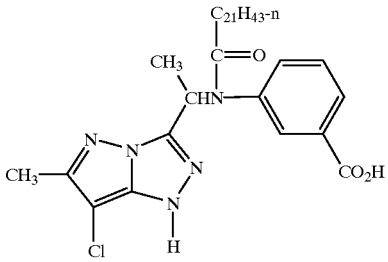

-continued
C3
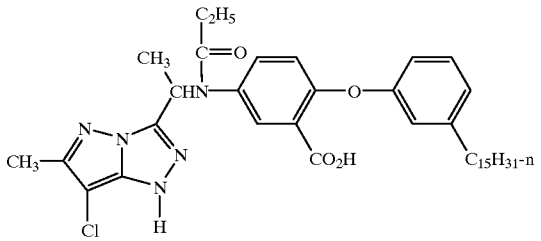
C4
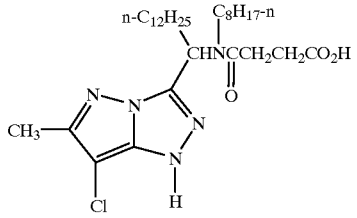
C5
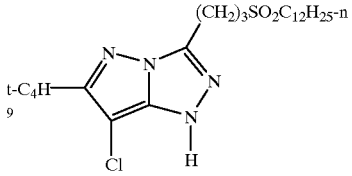
C6
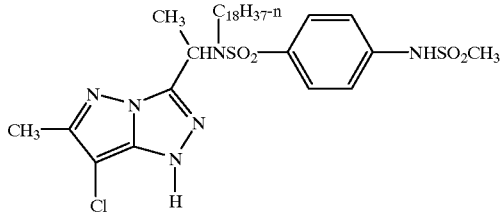
C7
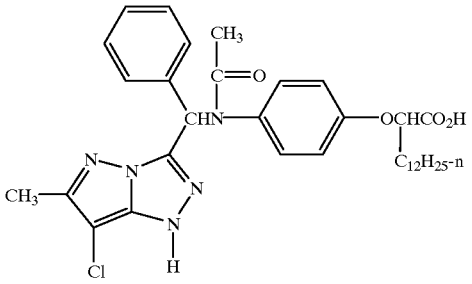
C8
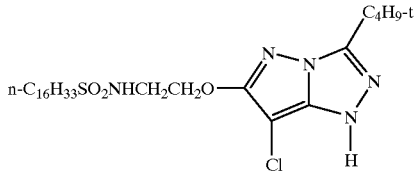
C9
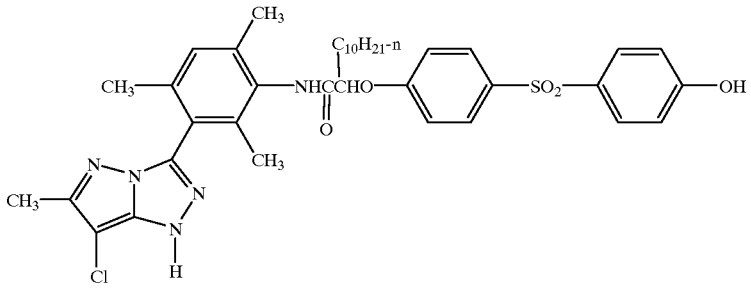
C10
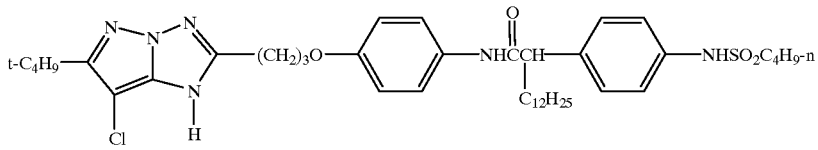
C11
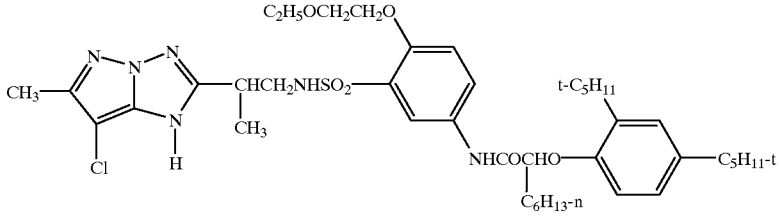

-continued

C12

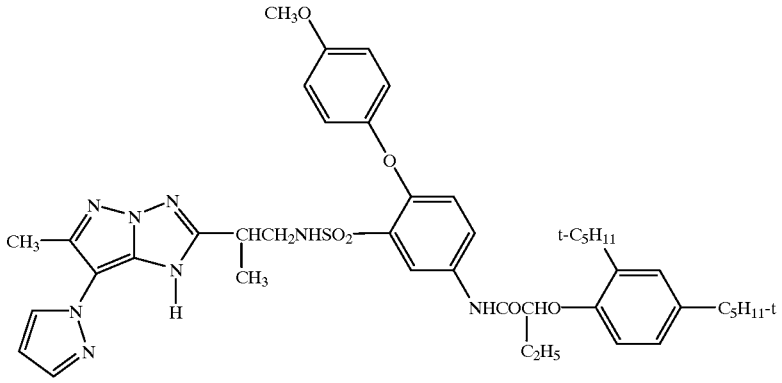

The DIR and imaging coupler combinations of this invention may be used with a variety of other couplers in the same layer or in different layers of a multilayer photographic material. Specifically contemplated is the use of the coupler combinations of this invention together with yellow-colored masking couplers and in particular magenta dye-forming, yellow-colored masking couplers. Also specifically contemplated is the use of the DIR and imaging coupler combinations of this invention in color negative films comprising magnetic recording layers. The efficient DIR/imaging coupler combinations of this invention may allow reductions in the coated levels of yellow-colored masking couplers in such films, thereby lowering blue minimum densities, which may otherwise be undesirably high.

The emulsion layer of the photographic element of the invention can comprise any one or more of the light sensitive layers of the photographic element. The photographic elements made in accordance with the present invention can be black and white elements, single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective (for example, a paper support).

Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945 and U.S. Pat. No. 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

In the following discussion of suitable materials for use in elements of this invention, reference will be made to *Research Disclosure*, September 1996, Number 389, Item 38957, which will be identified hereafter by the term "Research Disclosure I." The Sections hereafter referred to are Sections of the Research Disclosure I unless otherwise indicated. All Research Disclosures referenced are published by Kenneth Mason Publications, Ltd., Dudley Annex, 12a North Street, Emsworth, Hampshire P010 7DQ, ENGLAND. The foregoing references and all other references cited in this application, are incorporated herein by reference.

The silver halide emulsions employed in the photographic elements of the present invention may be negative-working, such as surface-sensitive emulsions or unfogged internal latent image forming emulsions, or positive working emulsions of the internal latent image forming type (that are fogged during processing). Suitable emulsions and their preparation as well as methods of chemical and spectral sensitization are described in Sections I through V. Color materials and development modifiers are described in Sections V through XX. Vehicles which can be used in the photographic elements are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in Section XI, exposure alternatives in Section XVI, and processing methods and agents in Sections XIX and XX.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); development inhibitors and their precursors (U.S. Pat. No. 5,460,932; U.S. Pat. No. 5,478,711); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may further contain other image-modifying compounds such as "Development Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. No. 4,346,165; U.S. Pat. No. 4,540,653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds which may be usefull in the elements of the invention are disclosed in Japanese Published Applications 83-09,959; 83-62,586; 90-072,629; 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90-080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The silver halide used in the photographic elements may be silver iodobromide, silver bromide, silver chloride, silver chlorobromide, silver chloroiodobromide, and the like.

The type of silver halide grains preferably include polymorphic, cubic, and octahedral. The grain size of the silver halide may have any distribution known to be useful in photographic compositions, and may be either polydispersed or monodispersed.

Tabular grain silver halide emulsions may also be used. Tabular grains are those with two parallel major faces each clearly larger than any remaining grain face and tabular grain emulsions are those in which the tabular grains account for at least 30 percent, more typically at least 50 percent, preferably >70 percent and optimally >90 percent of total grain projected area. The tabular grains can account for substantially all (>97 percent) of total grain projected area. The tabular grain emulsions can be high aspect ratio tabular grain emulsions—i.e., ECD/t>8, where ECD is the diameter of a circle having an area equal to grain projected area and t is tabular grain thickness; intermediate aspect ratio tabular grain emulsions—i.e., ECD/t=5 to 8; or low aspect ratio tabular grain emulsions—i.e., ECD/t=2 to 5. The emulsions typically exhibit high tabularity (T), where T (i.e., $ECD/t^2$) >25 and ECD and t are both measured in micrometers ($\mu$m). The tabular grains can be of any thickness compatible with achieving an aim average aspect ratio and/or average tabularity of the tabular grain emulsion. Preferably the tabular grains satisfying projected area requirements are those having thicknesses of <0.3 $\mu$m, thin (<0.2 $\mu$m) tabular grains being specifically preferred and ultra-thin (<0.07 $\mu$m) tabular grains being contemplated for maximum tabular grain performance enhancements. When the native blue absorption of iodohalide tabular grains is relied upon for blue speed, thicker tabular grains, typically up to 0.5 mm in thickness, are contemplated.

High iodide tabular grain emulsions are illustrated by House U.S. Pat. No. 4,490,458, Maskasky U.S. Pat. No. 4,459,353 and Yagi et al EPO 0 410 410.

Tabular grains formed of silver halide(s) that form a face centered cubic (rock salt type) crystal lattice structure can have either {100} or {111} major faces. Emulsions containing {111} major face tabular grains, including those with controlled grain dispersities, halide distributions, twin plane spacing, edge structures and grain dislocations as well as adsorbed {111} grain face stabilizers, are illustrated in those references cited in *Research Disclosure I*, Section I.B.(3) (page 503).

The silver halide grains to be used in the invention may be prepared according to methods known in the art, such as those described in *Research Disclosure I* and James, *The Theory of the Photographic Process*. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc., at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure*, Item 38957, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in Research Disclosure Item 36736 published November 1994, here incorporated by reference.

The SET dopants are effective at any location within the grains. Generally better results are obtained when the SET dopant is incorporated in the exterior 50 percent of the grain, based on silver. An optimum grain region for SET incorporation is that formed by silver ranging from 50 to 85 percent of total silver forming the grains. The SET can be introduced all at once or run into the reaction vessel over a period of time while grain precipitation is continuing. Generally SET forming dopants are contemplated to be incorporated in concentrations of at least $1\times10^{-7}$ mole per silver mole up to their solubility limit, typically up to about $5\times10^{-4}$ mole per silver mole.

SET dopants are known to be effective to reduce reciprocity failure. In particular the use of iridium hexacoordination complexes or $Ir^{+4}$ complexes as SET dopants is advantageous.

Iridium dopants that are ineffective to provide shallow electron traps (non-SET dopants) can also be incorporated into the grains of the silver halide grain emulsions to reduce reciprocity failure. To be effective for reciprocity improvement the Ir can be present at any location within the grain structure. A preferred location within the grain structure for Ir dopants to produce reciprocity improvement is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations.

The contrast of the photographic element can be further increased by doping the grains with a hexacoordination complex containing a nitrosyl or thionitrosyl ligand (NZ dopants) as disclosed in McDugle et al U.S. Pat. No. 4,933,272, the disclosure of which is here incorporated by reference.

The contrast increasing dopants can be incorporated in the grain structure at any convenient location. However, if the NZ dopant is present at the surface of the grain, it can reduce the sensitivity of the grains. It is therefore preferred that the NZ dopants be located in the grain so that they are separated from the grain surface by at least 1 percent (most preferably at least 3 percent) of the total silver precipitated in forming the silver iodochloride grains. Preferred contrast enhancing concentrations of the NZ dopants range from $1\times10^{-11}$ to $4\times10^{-8}$ mole per silver mole, with specifically preferred concentrations being in the range from $10^{-10}$ to $10^{-8}$ mole per silver mole.

Although generally preferred concentration ranges for the various SET, non-SET Ir and NZ dopants have been set out above, it is recognized that specific optimum concentration ranges within these general ranges can be identified for specific applications by routine testing. It is specifically contemplated to employ the SET, non-SET Ir and NZ dopants singly or in combination. For example, grains containing a combination of an SET dopant and a non-SET Ir dopant are specifically contemplated. Similarly SET and NZ dopants can be employed in combination. Also NZ and Ir dopants that are not SET dopants can be employed in combination. Finally, the combination of a non-SET Ir dopant with a SET dopant and an NZ dopant. For this latter three-way combination of dopants it is generally most convenient in terms of precipitation to incorporate the NZ dopant first, followed by the SET dopant, with the non-SET Ir dopant incorporated last.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions.

The silver halide to be used in the invention may be advantageously subjected to chemical sensitization. Compounds and techniques useful for chemical sensitization of silver halide are known in the art and described in *Research Disclosure I* and the references cited therein. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C., as described in *Research Disclosure I*, Section IV (pages 510–511) and the references cited therein.

The silver halide may be sensitized by sensitizing dyes by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I*, section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I*, or in T. H. James, editor, *The Theory of the Photographic Process*, 4th Edition, Macmillan, N.Y., 1977. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines.

Especially preferred are:

4-amino N,N-diethylaniline hydrochloride, 4-amino-3-methyl-N,N-diethylaniline hydrochloride, 4-amino-3-methyl-N-ethyl-N-(b-(methanesulfonamido) ethylaniline sesquisulfate hydrate, 4-amino-3-methyl-N-ethyl-N-(b-hydroxyethyl)aniline sulfate, 4-amino-3-b-(methanesulfonamido)ethyl-N,N-diethylaniline hydrochloride and 4-amino-N-ethyl-N-(2-methoxyethyl)-m-toluidine di-p-toluene sulfonic acid.

Dye images can be formed or amplified by processes which employ in combination with a dye-image-generating reducing agent an inert transition metal-ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent as illustrated by Matejec U.S. Pat. No. 3,674,490, *Research Disclosure*, Vol. 116, December, 1973, Item 11660, and Bissonette *Research Disclosure*, Vol. 148, August, 1976, Items 14836, 14846 and 14847. The photographic elements can be particularly adapted to form dye images by such processes as illustrated by Dunn et al U.S. Pat. No. 3,822,129, Bissonette U.S. Pat. Nos. 3,834,907 and 3,902,905, Bissonette et al U.S. Pat. No. 3,847,619, Mowrey U.S. Pat. No. 3,904,413, Hirai et al U.S. Pat. No. 4,880,725, Iwano U.S. Pat. No. 4,954,425, Marsden et al U.S. Pat. No. 4,983,504, Evans et al U.S. Pat. No. 5,246,822, Twist U.S. Pat. No. 5,324,624, Fyson EPO 0 487 616, Tannahill et al WO 90/13059, Marsden et al WO 90/13061, Grimsey et al WO 91/16666, Fyson WO 91/17479, Marsden et al WO 92/01972. Tannahill WO 92/05471, Henson WO 92/07299, Twist WO 93/01524 and WO 93/11460 and Wingender et al German OLS 4,211,460.

Development is followed by bleach-fixing, to remove silver or silver halide, washing and drying.

Synthesis of A1

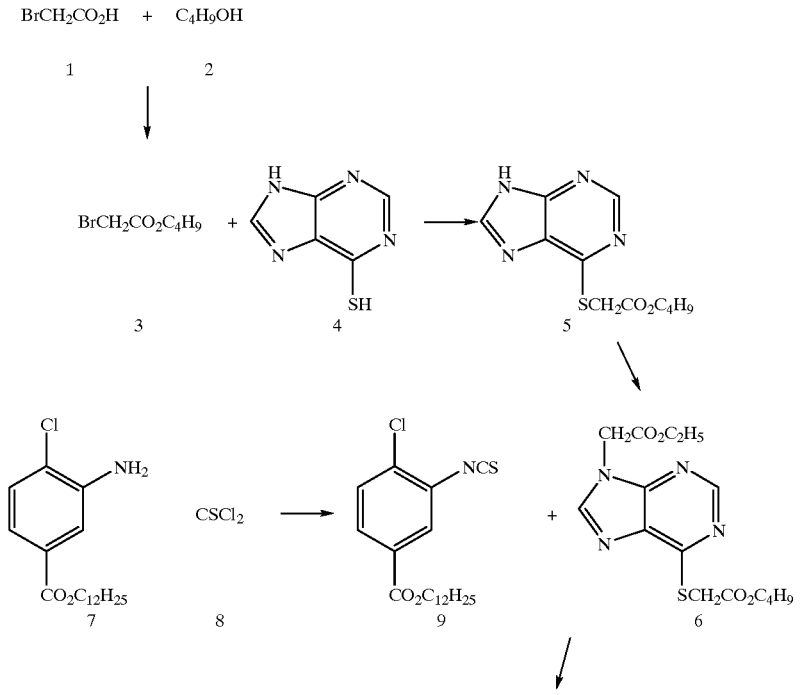

-continued

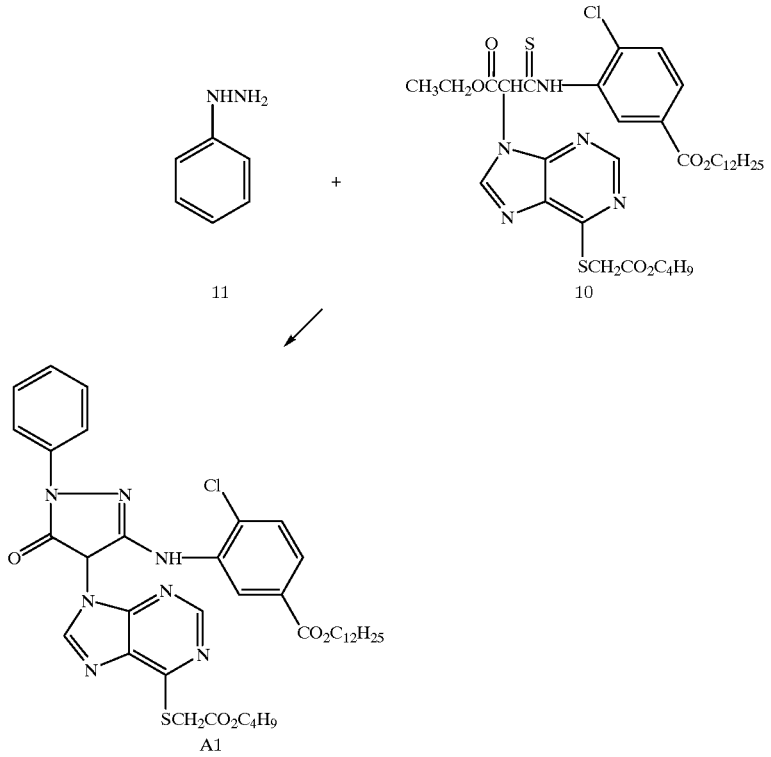

Synthesis of Compound 5

Bromoacetic acid 1 (25 grams, 0.18 moles) was dissolved in dichloromethane (800 mL) and 1-butyl alcohol 2 (16.6 mL, 0.18 moles) and treated with a catalytic amount of N,N-dimethylaminopyridine (DMAP). Dicyclohexylcarbodiimide (DCC, 37 grams, 0.18 moles) was dissolved in dichloromethane (200 mL) and added dropwise to the mechanically stirred solution. During addition, a slight exotherm was noticed, and a solid came out of solution. The reaction was allowed to stir for 30 minutes. The solid was removed by filtration and discarded. The dichloromethane was removed under reduced pressure. The resulting ester 3 was redissolved in dichloromethane (200 mL) and added in one portion to a stirred solution of 6-mercaptopurine 4 in a methanol (400 mL) and sodium methoxide (7.9 grams, 0.16 moles). The reaction was stirred at ambient temperature for one hour. Cold water (1200 mLs) was added to the solution. The solid which formed was filtered, washed with ligroin and air dried to give 22.8 grams (57% yield) of 5 as a white crystalline solid. The structure was confirmed by NMR spectroscopy.

Synthesis of 6

Compound 5 (20 grams, 0.075 moles) and ethyl bromo acetate (8.3 mL, 0.075 moles) were dissolved in tetrahydrofuran (250 mL) and treated in one portion with triethylamine (10.5 mL, 0.075 moles). The reaction was stirred at ambient temperature for 16 hours. Thin layer chromatography (TLC, ethyl acetate 70%, Heptane 30%) showed no starting material and one new spot. The reaction mixture was partitioned between dilute HCl and ethyl acetate. The product was extracted into ethyl acetate. The organic layer was dried with magnesium sulfate and concentrated to a wet solid. This was slurried in ethyl ether. The solid was filtered and discarded. The ether was concentrated to an oil. This was slurried in ligroin to give a white solid, filtered and air dried to give 13.5 grams (51%) of 6. The structure was confirmed by NMR spectroscopy.

Synthesis of 9

Compound 7 (54.4 grams, 0.16 moles) was dissolved in a mixture of acetone (300 mL) and tetrahydrofuran (80 mL). To this solution, thiophosgene 8 (14.4 mL, 0.19 moles) was added in one portion. A slight exotherm was noticed upon addition. After 5 hours, TLC (ethyl acetate 30%, heptane 70%) showed one major new spot and a small amount of starting material. Excess 8 was added (3 mL, 0.04 moles) and stirred at room temperature overnight. The reaction was poured into 1000 mL of ice/water with stirring. The material which oiled out was extracted into ethyl acetate. The organic layer was dried with magnesium sulfate and concentrated to a dark oil. The oil was dissolved in 175 mL of low boiling ligroin. This was chilled in a dry ice/acetone bath. Upon stirring and cooling a solid crystallized out. The solid was filtered and air dried to give 51.8 grams (85% yield) of 9 as a beige solid. The structure was confirmed by NMR spectroscopy.

Synthesis of 10

The purine 6 (13.5 grams, 0.038 moles) and the isothiocyanate 9 (16.1 grams, 0.042 moles) were dissolved in dimethylformamide (150 mL) and cooled to 5 degrees C with an ice/acetone bath. Potassium t-butoxide (4.7 grams, 0.042 moles) was then added in portions over 15 minutes. An exotherm to 10 degrees C was noticed. The reaction was allowed to stir at or below 10 degrees C for 2 hours. The reaction was poured into cold dilute HCl and extracted into ethyl acetate. The organic layer was dried with magnesium sulfate and concentrated to an oil. This was dissolved in toluene, placed on a silica gel column and purified by chromatography (eluting with ligroin/ethyl acetate up to 35%). This gave 10 as an oil. The oil was used without further purification in the synthesis of 12.

Synthesis of A1

Compound 10 (6.7 grams, 0.009 moles) was dissolved in 100 mL of tetrahydrofuran. This was treated first with phenyl hydrazine 11 (1 gram, 0.009 moles), secondly with a catalytic amount of DMAP and lastly with DCC in 25 mL of THF. The reaction was stirred at room temperature for 30 minutes. TLC (ethyl acetate 50%, heptane 50%) showed no starting material and one major new spot (a). Diazabicycloundecene (2.7 mL, 0.018 moles) was then added slowly to the reaction. After 15 minutes TLC (dichloromethane 80%, acetonitrile 19%, acetic acid 1%) showed no starting material a and one major new spot of lower rf. The mixture was partitioned between dilute HCl and ethyl acetate, and extracted into ethyl acetate. The organic layer was dried with magnesium sulfate and concentrated to a solid. It was then dissolved in dichloromethane and chromatographed, eluting with dichloromethane 80%, acetonitrile 19%, acetic acid 1% and concentrated to a solid. This was slurried in ether, filtered and air dried to give A1, 2.9 grams (42% yield). Structure was confirmed by NMR and Mass Spectrometry.

EXAMPLE 1

Illustration of Improved Inhibition Efficiencies Provided by the DIR/Imaging Coupler Combinations of this Invention.

To illustrate the superior inhibition and interlayer interimage provided by the DIR coupler/imaging coupler combinations of this invention, the performance of the combination of pyrazolone coupler B1 and DIR coupler A1 of this invention was compared to the performance of the combination of B1 and comparative DIR coupler D1 in the multilayer causer/receiver photographic format shown in Table I. Structures of components that were not given previously are provided after Table I. Component laydowns in g/sq m are given in Table I in parentheses. DIR couplers D1 and A1 were both coated at a level of 172 micromoles/sq m. Both DIR couplers were dispersed at a 1:2 weight ratio in tritolyl phosphate (S-1, mixed isomers). The dispersions were prepared by adding an oil phase containing a 1:2:3 weight ratio of DIR coupler:S-1:ethyl acetate to an aqueous phase containing gelatin and the dispersing agent ALKANOL XC (DuPont) in a 10:1 weight ratio. The mixture was then passed through a colloid mill to disperse the oil phase in the aqueous phase as small particles. On coating, the ethyl acetate auxiliary solvent evaporates. Coupler B1 was coated with S-1 and ST-1 (see below) at a 1:0.8:0.2 weight ratio.

TABLE I

| | | |
|---|---|---|
| OVERCOAT: | | Gelatin (2.69) |
| | | Bis(vinylsulfonyl)methane Hardner (0.227) |
| CAUSER: | | B1 (0.43) & S-1 (0.344) & ST-1 (0.086) |
| | A) | No DIR coupler (Uninhibited Check) |
| or | B) | D1 (0.133) & S-1 (0.266) Comparative |
| or | C) | A1 (0.131) & S-1 (0.262) Invention |
| | | Green-Sens. Silver Iodobromide T-Grain Emulsion (0.807 Ag) |
| | | Gelatin (2.69) |
| INTERLAYER: | | IS-1 (0.054) & S-1 (0.054) |
| | | Gelatin (0.86) |
| RECEIVER: | | CC-1 (0.753) & S-2 (0.753) |
| | | CB-2 (0.054) & S-3 (0.054) |
| | | IR-4 (0.022) & S-5 (0.044) |
| | | Red-Sens. Silver Iodobromide T-Grain Emulsion (0.807 Ag) |
| | | Gelatin (2.69), Tetraazaindene (0.019) |

TABLE I-continued

Cellulose Acetate Support with Gel U-Coat and Antihalation Backing

D-1

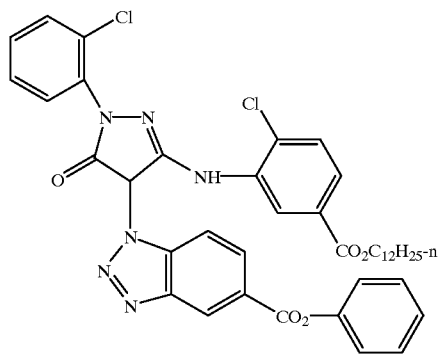

CC-1

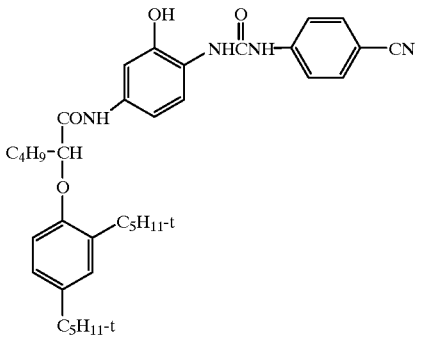

S-1

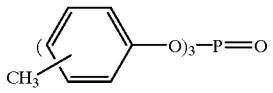

mixed isomers

ST-1

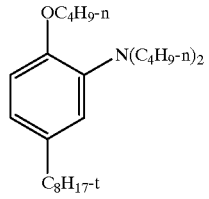

IS-1

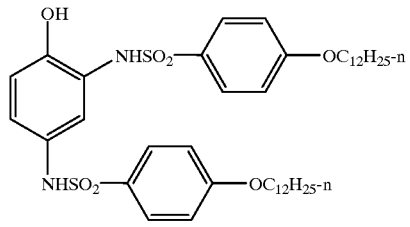

TABLE I-continued

IR-4

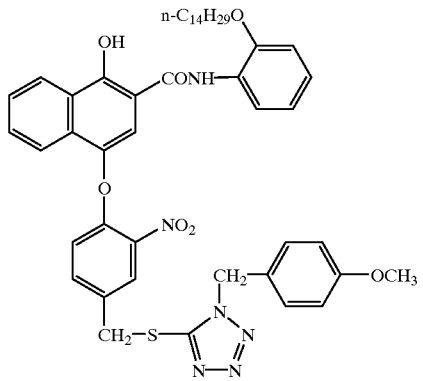

CB-2

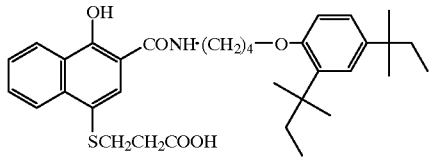

S-2

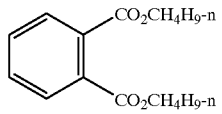

S-3

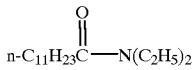

S-5

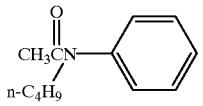

Film samples were given a sensitometric white light (neutral) exposure and processed in a KODAK FLEXICOLOR C-41 process as in Table II. Green (causer) and red (receiver) status M densities vs exposure were then measured for check film A without DIR coupler and for films B and C with DIR couplers D1 and A1, respectively. Green and red gamma values were then obtained from the slopes of the plots of density vs log exposure. It is desirable that DIR couplers efficiently reduce gamma or contrast in the layer or color record in which they are coated to provide benefits such as enhanced sharpness, reduced granularity and improved exposure latitude. For good interlayer interimage and high color correction it is also desirable a DIR coupler produce substantial gamma reduction in receiver layers without too much gamma reduction in its own (causer) layer and at reasonably low laydowns. In this case green gamma corresponds to causer gamma and red gamma to receiver gamma. Green and red gamma values resulting from neutral exposures are given in Table III. The ratio of red to green gamma (R) is also given in Table III. Low values of R are indicative of high interlayer interimage, while low values of red gamma are indicative of efficient production of interlayer interimage.

TABLE II

C-41 Processing Solutions and Conditions

| Solution | Process Time | Agitation Gas |
|---|---|---|
| C-41 Developer | 3'15" | Nitrogen |
| Stop Bath | 30" | Nitrogen |
| Wash | 2'00" | None |
| Bleach | 3'00" | Air |
| Wash | 3'00" | None |
| Fix | 4'00" | Nitrogen |
| Wash | 3'00" | None |
| Wetting Agent Bath | 30" | None |
| Process temperature 100° F. (38° C.). | | |

TABLE III

| Coating | DIR Coupler | Green Gamma | Red Gamma | R |
|---|---|---|---|---|
| A | None (Check) | 1.575 | 1.105 | 0.70 |
| B | D1 (Comparison | 1.230 | 0.718 | 0.58 |
| C | A1 Invention | 0.937 | 0.548 | 0.58 |

From the data in Table III it is apparent that DIR coupler A1 of this invention when used in combination with imaging coupler B1 provides a much higher reduction in green gamma than does the combination of comparative coupler D1 with B1. This means the A1/B1 combination is much more efficient in providing the benefits of improved sharpness, reduced granularity and increased exposure latitude that are associated with a reduction in green contrast. Furthermore, the combination of couplers A1 and B1 of this invention produces a much greater reduction in red or receiver gamma compared to the combination of D1 and B1, which means that the A1/B1 combination more efficiently delivers interimage. While the DIR coupler A1 of this invention delivers a greater reduction in receiver gamma at the same molar laydown as D1, it delivers a comparable reduction in receiver gamma relative to causer gamma as indicated by the ratio R.

EXAMPLE 2

Illustration of Improved Inhibition Efficiencies Provided by the Combinations of DIR couplers and Pyrazolotriazole Imaging Couplers of this Invention.

To further illustrate the superior inhibition and interlayer interimage provided by the DIR coupler/imaging coupler combinations of this invention, the performance of the combination of the pyrazolotriazole coupler C2 and DIR coupler A1 of this invention was compared to the performance of combinations of C2 with comparative DIR couplers D1 and D2 (structure below) in the multilayer causer/receiver photographic format shown in Table IV. This is very similar to the format of Table I, but the pyrazolone imaging coupler B1 has been replaced with C2. Component laydowns in g/sq m are given Table II in parentheses. DIR couplers D1, D2 and A1 were all coated at a level of 129 micromoles/sq m.

The DIR couplers were dispersed at a 1:2 weight ratio in tritolyl phosphate (S-1, mixed isomers). The dispersions were prepared by adding an oil phase containing a 1:2:3 weight ratio of DIR coupler:S-1; ethyl acetate to an aqueous phase containing gelatin and the dispersing agent ALKANOL XC (Dupont) in a 10:1 weight ratio. The mixture was then passed through a colloid mill to disperse the oil phase in the aqueous phase as small particles. On coating, the ethyl acetate auxiliary solvent evaporates. Coupler C2 was coated with S-1 at a 1:1 weight ratio.

TABLE IV

| | | |
|---|---|---|
| OVERCOAT: | | Gelatin (2.69) |
| | | Bis(vinylsulfonyl)methane Hardener (0.227) |
| CAUSER: | | C2 (0.35) & S-1 (0.35) |
| | D) | No DIR Coupler (Uninhibited Check) |
| or | E) | D1 (0.099) & S-1 (0.198) Comparative |
| or | F) | D2 (0.096) & S-1 (0.192) Comparative |
| or | G) | A1 (0.098) & S-1 (0.196) Invention |
| | | Green-Sens. Silver Iodobromide T-Grain Emulsion (0.807 Ag) |
| | | Gelatin (2.69) |
| INTERLAYER: | | IS-1 (0.054) & S-1 (0.054) |
| | | Gelatin (0.86) |
| RECEIVER: | | CC-1 (0.753) & S-2 (0.753) |
| | | CB-2 (0.054) & S-3 (0.054) |
| | | IR-5 (0.022) & S-5 (0.044) |
| | | Red-Sens. Silver Iodobromide T-Grain Emulsion (0.807 Ag) |
| | | Gelatin (2.69), tetraazaindine (0.019) |

Cellulose Acetate Support with Gel U-Coat and Antihalation Backing

D2

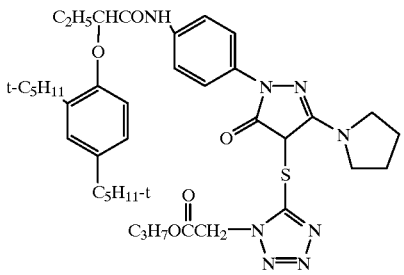

Film samples were given a sensitometric white light (neutral) exposure and processed in a KODAK FLEXICOLOR C-41 process as in Table II. Green (causer) and red (receiver) status M densities vs exposure were then measured for check film D without DIR coupler and for films E, F and G with DIR couplers D1, D2 and A1, respectively. Green and red gamma values were then obtained from the slopes of the plots of density vs log exposure. It is desirable that DIR couplers efficiently reduce gamma or contrast in the layer or color record in which they are coated to provide benefits such as enhanced sharpness, reduced granularity and improved exposure latitude. For good interlayer interimage and high color correction it is also desirable a DIR coupler produce substantial gamma reduction in receiver layers without too much gamma reduction in its own (causer) layer and at reasonably low laydowns. In this case green gamma corresponds to causer gamma and red gamma to receiver gamma. Green and red gamma values resulting from neutral exposures are given in Table V. The ratio of red to green gamma (R) is also given in Table V. Low values of R are indicative of high interlayer interimage, while low values of red gamma are indicative of efficient production of interlayer interimage.

TABLE V

| Coating | DIR Coupler | Green Gamma | Red Gamma | R |
|---|---|---|---|---|
| D | None (Check) | 1.965 | 1.080 | 0.55 |
| E | D1 (Comparison) | 1.890 | 0.797 | 0.42 |
| F | D2 (Comparison) | 1.645 | 0.843 | 0.51 |
| G | A1 (Invention) | 1.400 | 0.575 | 0.41 |

From the data in Table V it is apparent that DIR coupler A1 of this invention when used in combination with imaging coupler C2 provides a much higher reduction in green gamma than do the combinations of comparative couplers D1 or D2 with C2. This means the A1/C1 combination much more efficiently provides the benefits of enhanced sharpness, reduced granularity and increased exposure latitude that are associated with a reduction in green contrast. Furthermore, the combination of couplers A1 and C2 of this invention produces a much greater reduction in red or receiver gamma compared to the combinations of D1 and C2 or D2 and C2, which means that the A1/C2 combination more efficiently delivers interimage. While the DIR coupler A1 of this invention delivers a greater reduction in receiver gamma at the same molar laydown as D1 or D2, it also delivers more reduction in receiver gamma relative to causer gamma as indicated by the ratio R. It is often difficult to deliver reductions in causer and receiver gammas using pyrazolotriazole imaging couplers of structure IIIa or IIIb. The pyrazolone DIR couplers of this invention are surprisingly efficient in providing gamma reductions when used in combination with pyrazolotriazole imaging couplers such as C2.

EXAMPLE 3

Multilayer Film Structure Comprising DIR/Imaging Coupler Combinations of this Invention.

The multilayer film structure utilized for this example is shown schematically in Table VI. Structures of components not provided previously are given immediately following Table VI. Component laydowns are provided in units of g/sq m unless otherwise indicated. This composition may also be coated on a support, such as polyethylene naphthalate, containing a magnetic recording layer. This film may be processed using KODAK FLEXICOLOR C-41 chemistry to yield excellent latitude, sharpness, color and interlayer interimage.

TABLE VI

| MULTILAYER FILM STRUCTURE | | |
|---|---|---|
| 1 | Overcoat & UV Layer: | Matte Beads |
| | | UV Absorbers UV-1 (0.108, UV-2 (0.108 & S-1 (0.151) |
| | | Silver Bromide Lippmann Emulsion (0.215 Ag) |
| | | Gelatin (1.237) |
| | | Bis(vinylsulfonyl)methane Hardener (1.75% of Total Gelatin) |
| 2 | Fast Yellow Layer: | Y-1 (0.236) Yellow Dye-forming Coupler & S-1 (0.118) |
| | | IR-1 (0.073) DIR Coupler & S-1 (0.037) |
| | | CB-1 (0.0054 BARC & S-3 (0.0070) |
| | Blue Sensitive | Silver Iodobromide Emulsion (0.377 Ag), |
| | | 4.1 mole % Iodide T-Grain (2.9 × 0.12 μm) |

TABLE VI-continued

| | | |
|---|---|---|
| | Blue Sensitive | Silver Iodobromide Emulsion (0.108 Ag)<br>4.1 mole % Iodide T-Grain (1.9 × 0.14 μm)<br>Gelatin (0.807) |
| 3 | Slow Yellow Layer: | Y-1 (1.076) & S-1 (0.538)<br>IR-1 (0.073) (Invention) & S-1 (0.037)<br>CB-1 (0.022) & S-3 (0.0028)<br>CC-1 (0.032) & S-2 (0.064)<br>IR-4 (0.032) & S-2 (0.064) |
| | Blue Sensitive | Silver Iodobromide Emulsion (0.398 Ag),<br>4.1 mole % Iodide T-Grain (1.9 × 0.14 μm) |
| | Blue Sensitive | Silver Iodobromide Emulsion (0.269 Ag),<br>1.3 mole % Iodide T-Grain (0.54 × 0.08 μm) |
| | Blue Sensitive | Silver Iodobromide Emulsion (0.247 Ag)<br>1.5 mole % Iodide T-Grain (0.77 × 0.14 μm)<br>Gelatin (1.872) |
| 4 | Yellow Filter Layer | R-1 (0.086) & S-2 (0.139 & ST-2 (0.012)<br>YD-2 Filter Dye (0.054)<br>Gelatin (0.646) |
| 5 | Fast Magenta Layer: | B1 (0.038) Magenta Dye-Forming Coupler & S-1 (0.034) &<br>ST-1 (0.004), Addendum, R-2 (0.009)<br>A1 (0.030) DIR coupler of Invention & S-1 (0.060)<br>MM-1 (0.054) Masking Coupler & S-1 (0.108)<br>CB-1 (0.003) & S-3 (0.004) |
| | Green Sensitive | Silver Iodobromide Emulsion (0.484 Ag),<br>4.0 mole % Iodide T-Grain (1.60 × 0.12 μm)<br>Gelatin (1.014) |
| 6 | Mid Magenta Layer: | C2 (0.045) Magenta Dye-Forming Coupler & S-1 (0.045)<br>A1 (0.035) DIR Coupler of Invention & S-1 (0.070)<br>MM-1 (0.118) & S-1 (0.236), R-2 (0.015) |
| | Green Sensitive | Silver Iodobromide Emulsion (0.247 Ag),<br>4.0 mole % Iodide T-Grain (1.20 × 0.11 μm) |
| | Green Sensitive | Silver Iodobromide Emulsion (0.247 Ag),<br>4.0 mole % Iodide T-Grain (1.00 × 0.12 μm)<br>Gelatin (1.216) |
| 7 | Slow Magenta Layer: | B1 (0.269) & S-1 (0.242) & ST-1 (0.027)<br>MM-1 (0.086) & S-1 (0.172)<br>IR-3 (0.011) & S-2 (0.011) |
| | Green Sensitive | Silver Iodobromide Emulsion (0.344 Ag),<br>3.5 mole % Iodide T-Grain (0.90 × 0.12 μm) |
| | Green Sensitive | Silver Iodobromide Emulsion (0.129 Ag),<br>1.5 mole % Iodide T-Grain (0.50 × 0.08 μm)<br>Gelatin (1.076) |
| 8 | Interlayer: | R-1 (0.086) Interlayer Scavenger, S-2 (0.139)<br>& ST-2 (0.012)<br>Gelatin (0.538) |
| 9 | Fast Cyan Layer: | CC-1 (0.183) Cyan Dye-Forming Coupler & S-2 (0.210)<br>CM-1 (0.022) Masking Coupler<br>IR-4 (0.027) DIAR Coupler & S-2 (0.054) |
| | Red Sensitive | Silver Iodobromide Emulsion (0.592 Ag),<br>4.1 mole % Iodide T-Grain (1.7 × 0. μm)<br>Gelatin (0.915) |
| 10 | Mid Cyan Layer: | CC-1 (0.170) & S-2 (0.190)<br>CM-1 (0.032)<br>CB-1 (0.008) & S-3 (0.010)<br>IR-4 (0.019) & S-2 (0.038) |
| | Red Sensitive | Silver Iodobromide Emulsion (0.194 Ag),<br>4.1 mole % Iodide T-Grain (1.2 × 0.11 μm) |
| | Red Sensitive | Silver Iodobromide Emulsion (0.236 Ag),<br>4.1 mole % Iodide T-Grain (0.91 × 0.11 μm)<br>Gelatin (1.076) |
| 11 | Slow Cyan Layer: | CC-1 (0.533) & S-2 (0.560)<br>IR-4 (0.026) & S-2 (0.052)<br>CM-1 (0.031)<br>CB-1 (0.056) & S-3 (0.073) |
| | Red Sensitive | Silver Iodobromide Emulsion (0.436 Ag),<br>1.5 mole % Iodide T-grain (0.54 × 0.06 μm) |
| | Red Sensitive | Silver Iodobromide Emulsion (0.301 Ag)<br>4.1 mole % Iodide T-grain (0.53 × 0.12 μm)<br>Gelatin (1.679) |
| 12 | Antihalation Layer: | Gray Silver (0.135)<br>UV-1 (0.075), UV-2 (0.030), S-1 (0.105), S-4 (0.015)<br>YD-1 (0.034), MD-1 (0.018) & S-6 (0.018)<br>CD-1 (0.025) & S-2 (0.125)<br>R-1 (0.161), S-2 (0.261) & ST-2 (0.022)<br>Gelatin (2.044) |

TABLE VI-continued
| Cellulose Triacetate Support |
|---|
| S-4 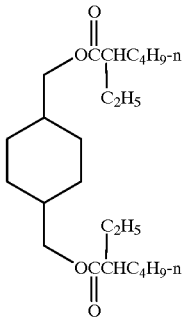 |
| S-6 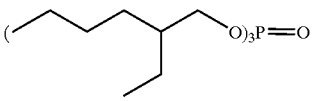 |
| UV-1 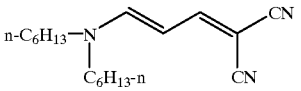 |
| UV-2 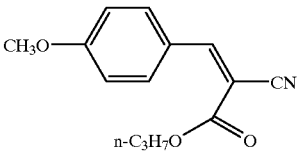 |
| R-1 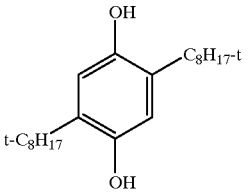 |
| ST-2 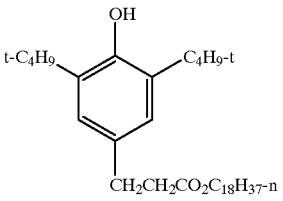 |
| YD-2 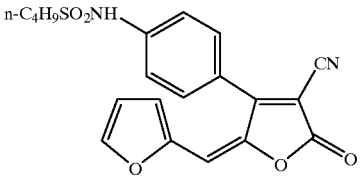 |

TABLE VI-continued
R-2
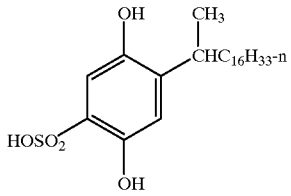
Y-1
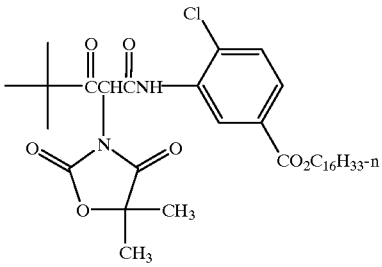
IR-1
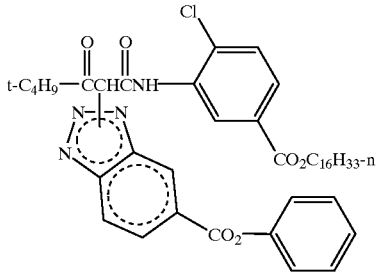
MM-1
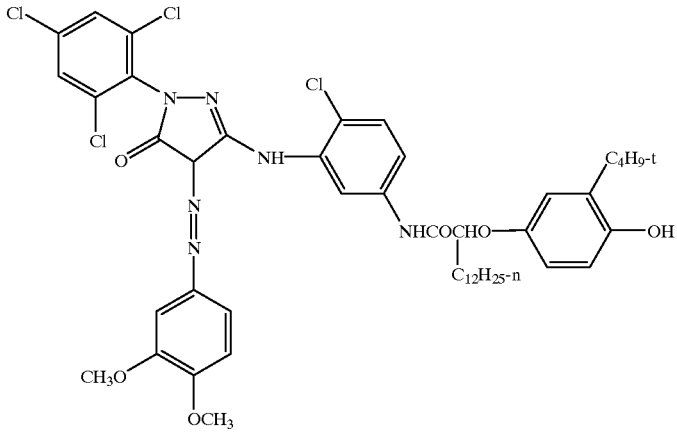

TABLE VI-continued
IR-2
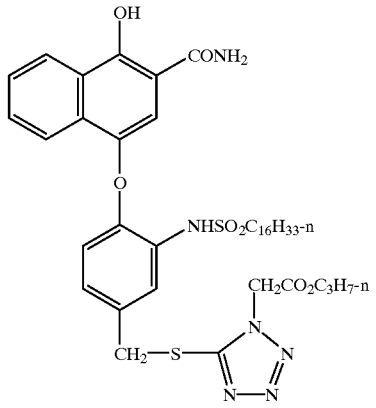
IR-3
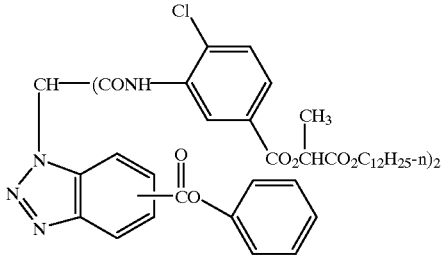
CB-1
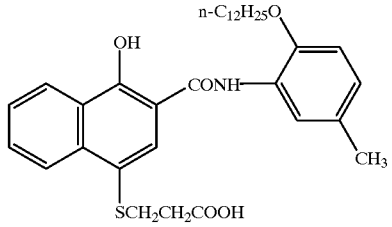
CM-1
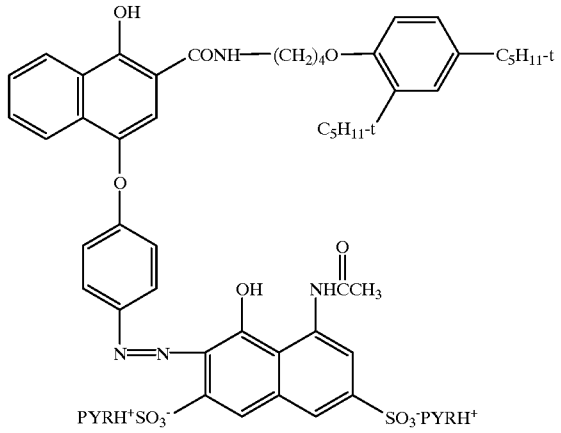

TABLE VI-continued

YD-1

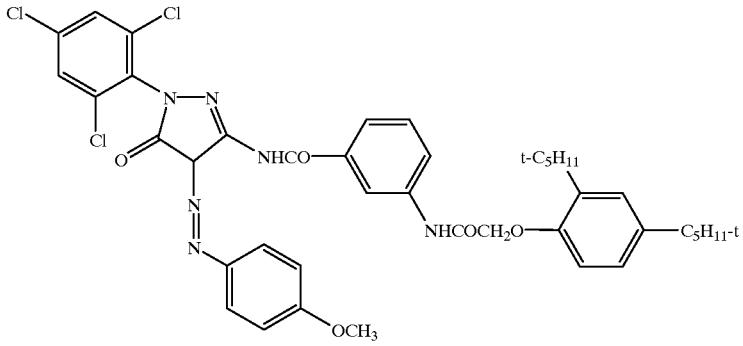

MD-1

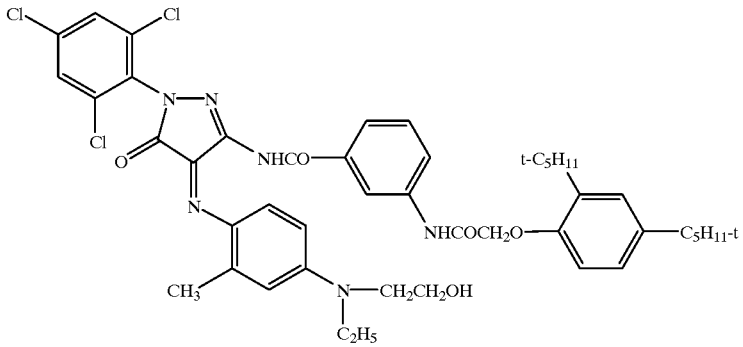

CD-1

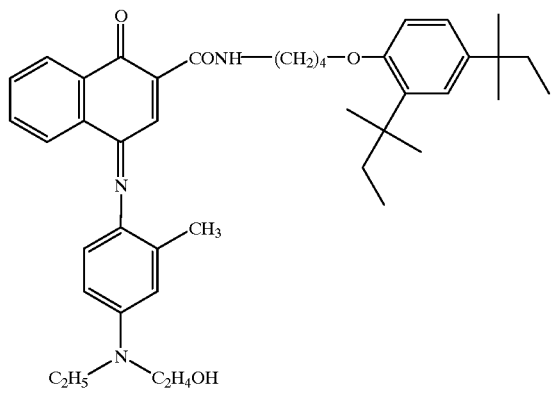

The invention has been described in detail with particular reference to preferred embodiments, but it will be understood that variations and modifications can be effected within the spirit and scope of the invention.

What is claimed is:

1. A photographic element comprising: (a) a support; and (b) at least one silver halide emulsion layer; wherein said emulsion layer contains (c) at least one magenta dye-forming pyrazolone DIR coupler of structure I; and (d) at least one magenta dye-forming imaging coupler of structure IIIa or structure IIIb, below:

I

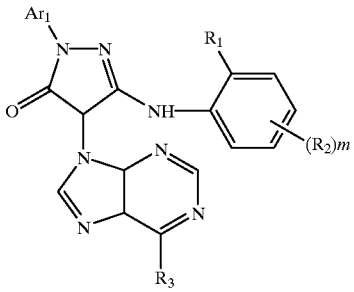

wherein:

$Ar_1$ is an unsubstituted aryl group or an aryl group with one or more substituents selected from the group consisting of halogen atoms, and alkyl, phenyl, alkoxy, phenoxy, carbonamido, sulfonamido, carbamoyl, sulfamoyl, alkoxycarbonyl, aryloxycarbonyl, acyloxy, alkylsulfonyl, arylsulfonyl, sulfonyloxy and alkylthio groups;

$R_1$ is a hydrogen or halogen atom or an alkyl or alkoxy group;

each $R_2$ is individually selected from the group consisting of halogen atoms, and alkyl, phenyl, alkoxy, phenoxy, carbonamido, sulfonamido, carbamoyl, sulfamoyl, alkoxycarbonyl, aryloxycarbonyl, acyloxy, alkylsulfonyl, arylsulfonyl, sulfoxyl, sulfonyloxy, alkylthio, arylthio, cyano and imido groups and is in the para position or either meta position relative to the NH group;

m is 0, 1, 2 or 3;

$R_3$ is an alkylthio, arylthio, alkoxy, phenoxy, sulfonamido or carbonamido (—$NHCOR_4$) group; and $R_4$ is an alkyl, phenyl, alkoxy or phenoxy group;

IIIa

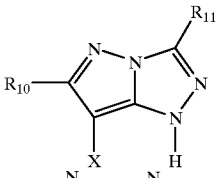

IIIb

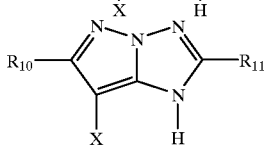

wherein:

$R_{10}$ and $R_{11}$ and are individually selected from the group consisting of hydrogen halogen atoms and alkyl, phenyl, alkoxy, phenoxy, carbonamido and sulfonamido groups;

X is hydrogen or a coupling-off group; and the total number of carbon atoms in $R_{10}$ and $R_{11}$ taken together is at least 8.

2. A photographic element according to claim 1, wherein the pyrazolone DIR coupler and imaging coupler are coated in the same layer as at least one green-sensitive silver halide emulsion.

3. A photographic element according to claim 1, wherein at least one ortho position of $Ar_1$ is unsubstituted.

4. A photographic element according to claim 1, wherein one ortho position of $Ar_1$ is unsubstituted and the other ortho position $Ar_1$ is substituted with a chlorine or fluorine atom or a methyl group.

5. A photographic element according to claim 1, wherein both ortho positions of $Ar_1$ are unsubstituted.

6. A photographic element according to claim 1, wherein $R_1$ is a chlorine or fluorine atom or a methyl group.

7. A photographic element according to claim 1, wherein m is 1 and $R_2$ is an electron-withdrawing group para to the NH group or to the $R_1$ group.

8. A photographic element according to claim 7, wherein $R_2$ is an alkoxycarbonyl group or an alkylsulfonyl group.

9. A photographic element according to claim 1, wherein the sum of the Hammett sigma values for all of the $R_2$ groups taken together is at least 0.3.

10. A photographic element according to claim 1, wherein $R_3$ is an alkylthio group.

11. A photographic element according to claim 10, wherein $R_3$ is a —$SCH_2CO_2R_5$ group, and $R_5$ has at least 3 carbon atoms.

12. A photographic element according to claim 11, wherein $R_5$ has 4–8 carbon atoms.

13. A photographic element according to claim 1, wherein the pyrazolone DIR coupler is selected from the group consisting of:

A1

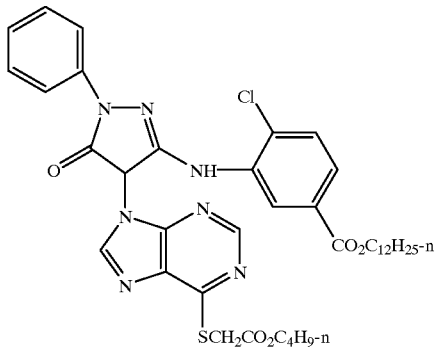

A2

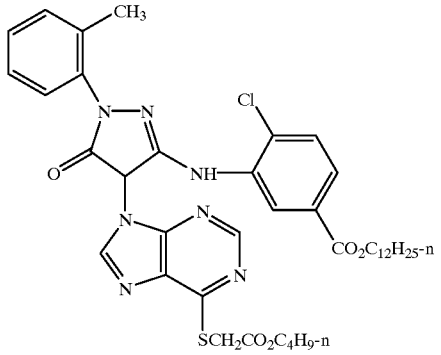

A3

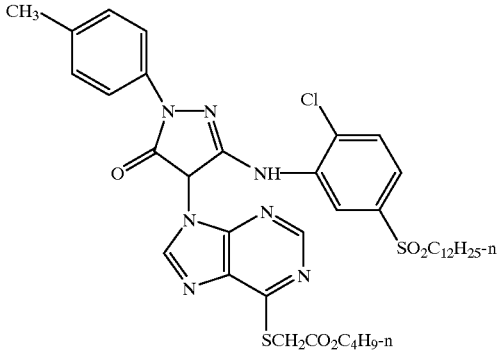

A4

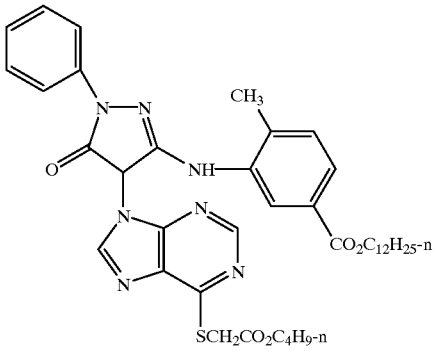

-continued
A5
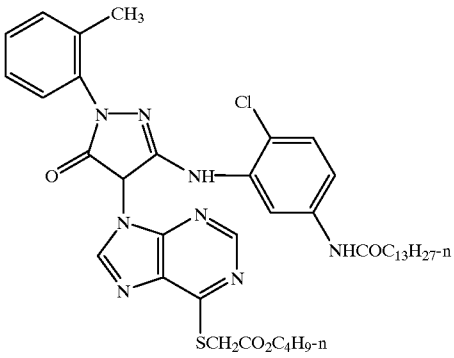
and
-continued
A6
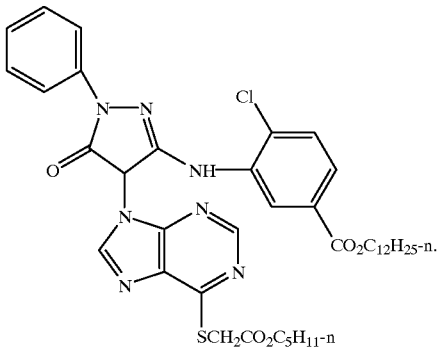
14. A photographic element according to claim 1, wherein pyrazolotriazole imaging coupler IIIa or IIIb is selected from the group consisting of:
C1
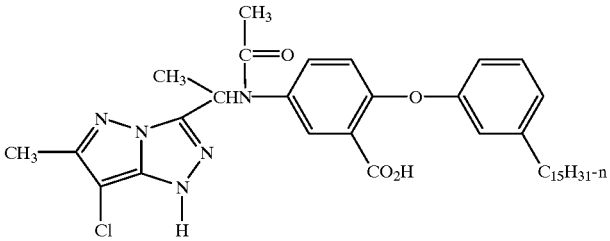
C2
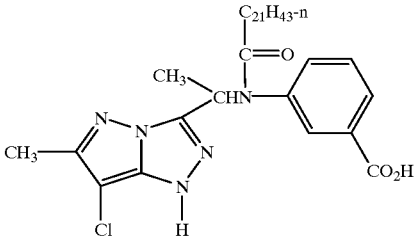
C11
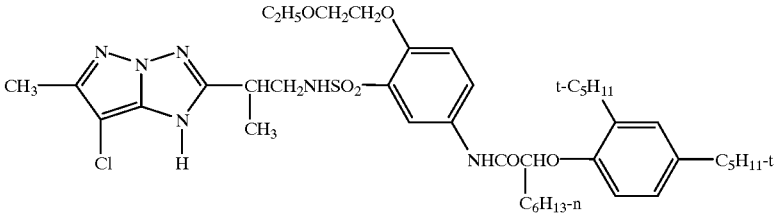
and -continued

C12

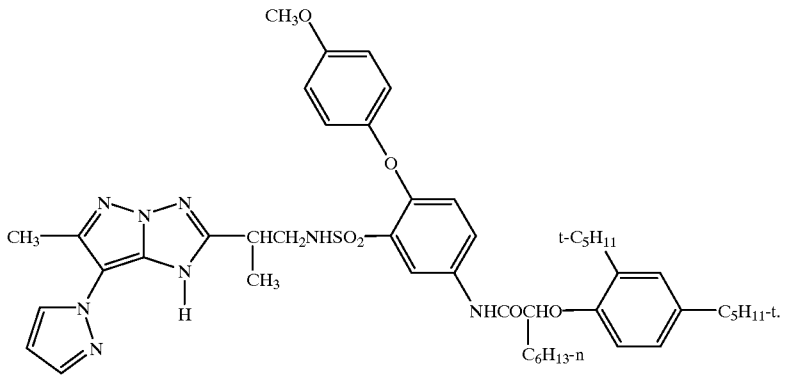

15. A photographic element according to claim 1, wherein the coated level of pyrazolone DIR coupler I is between 0.005 and 0.50 g/sq m.

16. A photographic element according to claim 15, wherein the coated level of I is between 0.010 and 0.25 g/sq m.

17. A photographic element according to claim 1, wherein the coated level if imaging coupler IIIa or IIIb is between 0.02 and 1.50 g/sq m.

18. A photographic element according to claim 1, wherein the film comprises a magnetic recording layer.

* * * * *